US006494236B2

(12) United States Patent
Chou

(10) Patent No.: US 6,494,236 B2
(45) Date of Patent: Dec. 17, 2002

(54) REVISED INTERLOCKING TAB OF A ZIPPER

(75) Inventor: Chao-Mu Chou, Taipei (TW)

(73) Assignees: Ching-Yu Chou, Taipei (TW); Shiu-Yin Cheng, Taoyuan Hsien (TW)

( * ) Notice: Subject to any disclaimer, the term of this patent is extended or adjusted under 35 U.S.C. 154(b) by 0 days.

(21) Appl. No.: 09/878,277

(22) Filed: Jun. 12, 2001

(65) Prior Publication Data

US 2002/0157220 A1 Oct. 31, 2002

(30) Foreign Application Priority Data

Apr. 25, 2001 (TW) ..... 90206603 U

(51) Int. Cl.[7] ..... D03D 25/00
(52) U.S. Cl. ..... 139/384 B; 139/383 R

(58) Field of Search ..... 139/384 B, 420 A, 139/383 R; 66/195, 193

(56) References Cited

U.S. PATENT DOCUMENTS

| | | | | | |
|---|---|---|---|---|---|
| 4,392,363 | A | * | 7/1983 | Matsuda | 66/193 |
| 4,561,474 | A | * | 12/1985 | Ofusa | 139/384 B |
| 5,469,605 | A | * | 11/1995 | Horikawa | 139/384 B |
| 6,330,892 | B1 | * | 12/2001 | Shimono | 139/384 B |

* cited by examiner

*Primary Examiner*—John J. Calvert
*Assistant Examiner*—Robert H Muromoto, Jr.
(74) *Attorney, Agent, or Firm*—Troxell Law Office PLLC

(57) ABSTRACT

An interlocking tab of a zipper includes engaging teeth and a cloth tape. The cloth tape includes a sewing part joined with the engaging teeth at the lateral side of the engaging teeth, and a stretch yarn woven part located away the sewing part enabling the cloth tape to be stretched to form a curve.

7 Claims, 2 Drawing Sheets

REVISED INTERLOCKING TAB OF A ZIPPER

BACKGROUND OF THE INVENTION

1. Field of the Invention

The present invention relates to a revised interlocking tab of a zipper, and particularly to an improvement on an interlocking tab of a zipper, with which a curve shaped zipper is possible to be formed easily and smoothly by way of a stretchy cloth tape and engaging teeth possible to be elongated.

2. Description of Related Art

The zipper is an interlocking device popularly used in out daily so that it can be seen easily in the ready-made clothes, hand bags, sleep bags, tents, . . . , and so on. The zipper provides advantages such as being conveniently operated and being durable, and these are the reason why it is so popularly used and replaces many of traditional interlocking device.

Mostly, there are three types of zippers available based on the material thereof and they are zippers respectively made of metal, nylon, and fiber-reinforced plastics. Usually, a zipper is composed of an interlocking tab and a slier and the interlocking tab provides two opposite lines of teeth for engaging with each other and a cloth tape extending laterally from the engaging teeth for being attached to an article by way of sewing. The engaging teeth on a metal zipper and on a zipper of fiber-reinforced plastics are independently disposed and neighboring teeth are equally spaced apart from each other such that two opposite lines of teeth can engage with each other. As for the nylon zipper, the teeth thereof are made from nylon or polyester filament being heat up and curled so as to form continuous spirals or coils for being able to engage with each other oppositely. Hence, the fabrication of the interlock tab on the nylon zipper is after the spirals or coils are formed before the cloth tape can be sewed onto an article.

Although the conventional zipper can interlock two part of an article, there is a slight imperfection that the zipper is limited to be formed as a shape of straight line. That is, it is hard to form a shape of curve for the zipper while -the sewing work is conducted, especially for the metal zipper and the zipper of fiber-reinforced plastics. The engaging teeth, on the metal zipper and the zipper of fiber-reinforced plastics have been fixed in shape such that it is very limited for the fixed teeth to be bent. As for the engaging teeth on the nylon zipper, although the shape of continuous coils and the flexure of the material make the engaging teeth possible to be bent appropriately, a fixed length of cloth tape makes the sewing work unable to be done easily.

The preceding bottleneck with regard to the zipper being used or being worked has restricted the product design to avoid the joining of curve and work with straight line only. However, the curve shape is inevitable for the product design or the fabrication of ready-made clothes so that how to obtain an interlocking tab being formed with curve shape is a subject worth us to develop so as to solve the problem of conventional zipper.

SUMMARY OF THE INVENTION

An object of the present invention is to provide a revised interlocking tab of a zipper, with which a curve shape for the zipper can be performed during being worked in addition to the shape of straight line due to a cloth tape thereof providing a feature of stretchy and engaging teeth thereof possible to be elongated.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
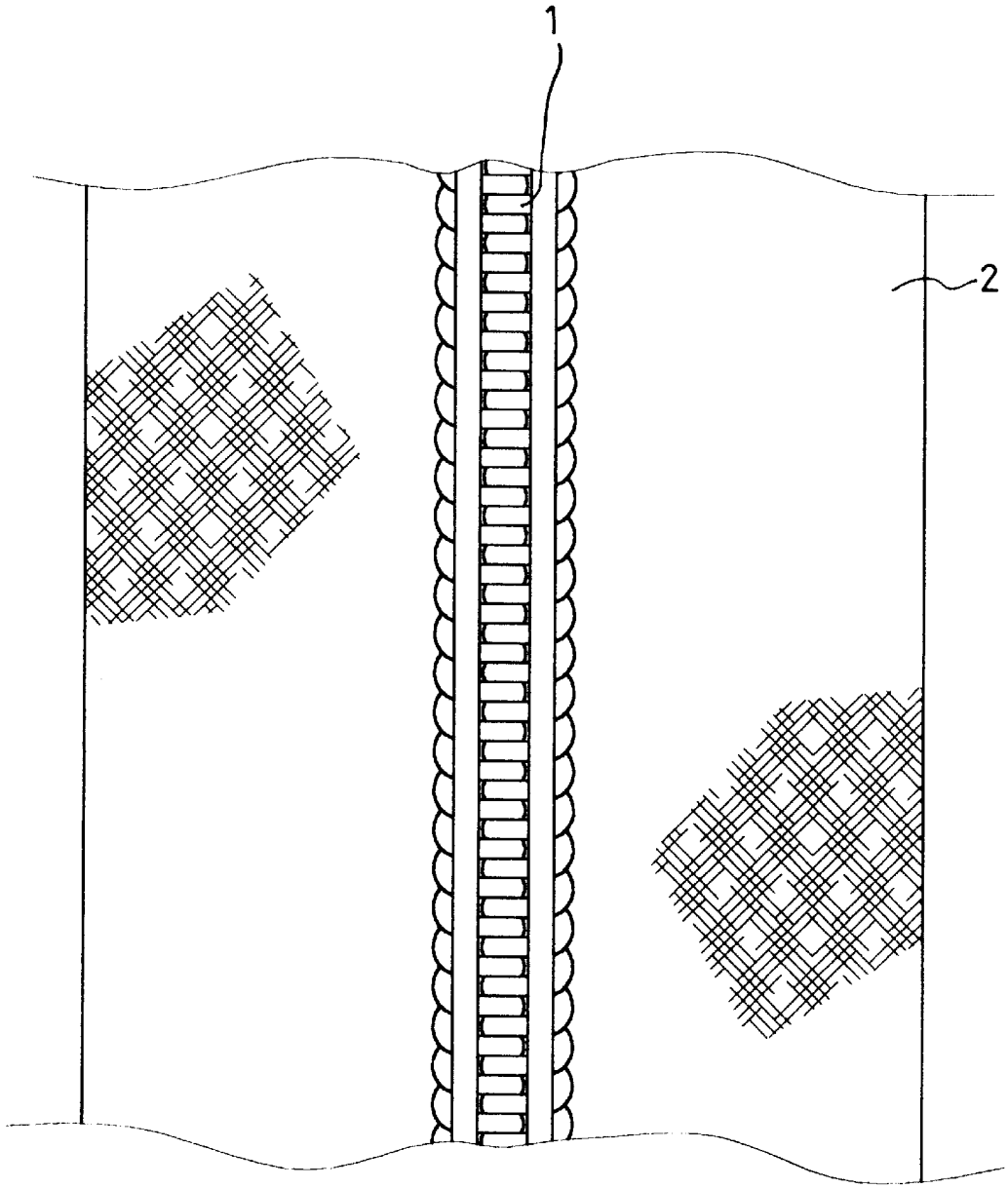
FIG. 1 is a fragmentary plan view of a revised interlocking tab according to the present invention.
Figure 2:
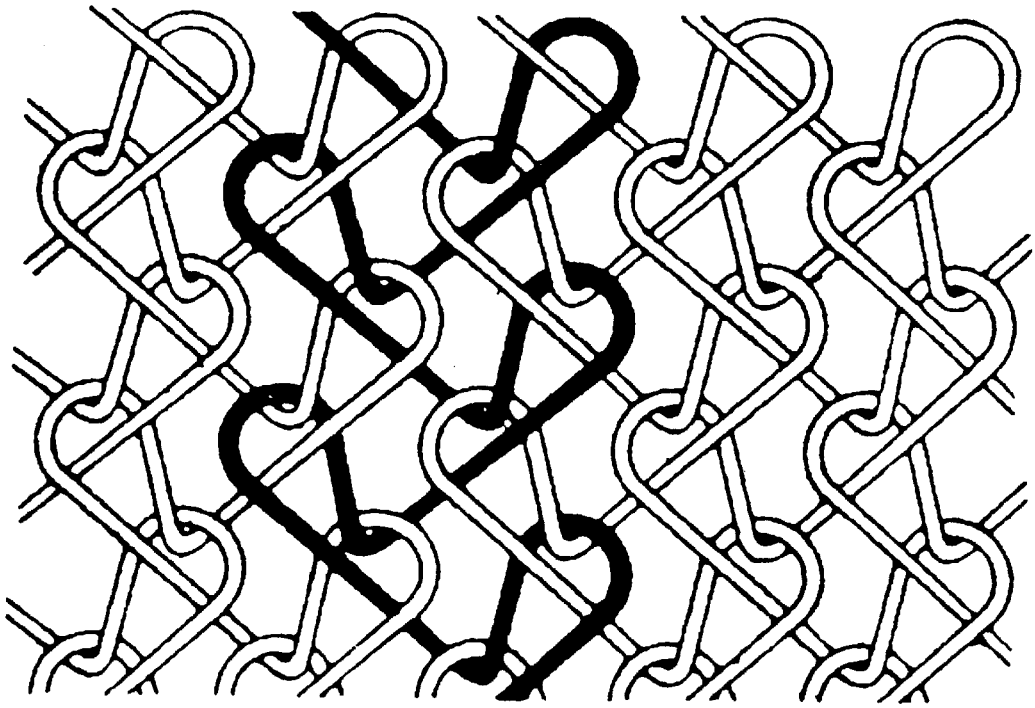
FIG. 2 is a diagram illustrating the cloth tape in the present invention being warp knitted.

Referring to FIGS. 1, and 2, a revised interlocking tab of a zipper according to the present invention. Comprising teeth 1 and a cloth tape 2 associated with the engaging teeth 1.

Wherein, the engaging teeth 1 is made by way of nylon or polyester filament, or the like being curled to form a continuous coil shape and are arranged oppositely so as to mesh with other. The formation of the engaging teeth 1 is belonged to conventional art and no further detail will be described.

The difference between the present invention and conventional tooth tab resides in that the cloth tape 2 shown in FIG. 2 is stretchy to cope with a change of shape due to forming a curve. Thus, the part without joining with the engaging teeth 1, that is, the part at the outer lateral side of engaging teeth 1 is woven with the texture yarn or stretch yarn part such as warp knitting to form continuous coils or loops between warp yams as shown in FIG. 2. As for the edges of the cloth tape 2 are made by way of conventional converged sides.

Please refer to FIGS. 1 and 2 again, the engaging teeth 1 and the cloth tape 2 can be spread out flatly and sewed together in case of a shape of straight line being worked. When a shape of curve is worked, the cloth tape 2 can be stretched and the coils or the loops can be elongated such that it is possible to form an unchanged curve shape after sewing.

The preceding warp knitting can be either warp knitting or weft knitting h either simple continuous coils or more complicated continuous coils to perform the effect of stretch and expansion.

Hence, it is appreciated that the present invention makes the interlocking tab possible to be worked with a curve shape and getting into form, and it expands the scope of zipper deign and has the zipper provide a curve shape as desired. Moreover, the present invention can enhance the quality of product and the accuracy of profiling.

While the invention has been described with reference to preferred embodiments thereof, it is to be understood that modifications or variations may be easily made without departing from the spirit of this invention, which is defined by the appended claims.

What is claimed is:

1. An interlocking tab of a zipper, comprising an elongated engaging teeth with a lateral side; and a cloth tape including a sewing part joined with the engaging teeth at the lateral side of said engaging teeth, and a stretch yarn woven part, wherein the cloth tape is made from the stretch yarn woven by way of warp knitting or weft knitting.

2. The interlocking tab of a zipper according to claim 1, wherein the stretch yarn on the cloth tape is man made fiber.

3. The interlocking tab of a zipper according to claim 1, wherein the cloth tape is made of polyester or filature.

4. An interlocking tab of a zipper, comprising an elongated engaging teeth with a lateral side; and a cloth tape including a sewing part joined with the engaging teeth at the lateral side of said engaging teeth, and a knitting part, wherein the cloth tape is woven with stretch yarn.

5. The interlocking tab of a zipper according to claim 4, wherein the cloth tape is provided with a selvage.

6. The interlocking tab of a zipper according to claim 4, wherein the cloth tape is spun with man made fiber.

7. The interlocking tab of a zipper according to claim 4, wherein the knitting is warp knitting or weft knitting.

* * * * *